United States Patent [19]

Lieber

[11] 4,248,127

[45] Feb. 3, 1981

[54] STRING NUT

[76] Inventor: Thomas G. Lieber, 9 E. Valley Stream Blvd., Valley Stream, N.Y. 11580

[21] Appl. No.: 114,222

[22] Filed: Jan. 22, 1980

[51] Int. Cl.[3] ..... G10D 3/12

[52] U.S. Cl. ..... 84/314 N; 84/297 R; 84/304

[58] Field of Search ..... 84/3, 4 R, 314 N, 297 R, 84/290, 293, 303-306

[56] References Cited

U.S. PATENT DOCUMENTS

| | | | |
|---|---|---|---|
| 1,173,002 | 5/1929 | Oettinger | 84/304 |
| 1,834,695 | 12/1931 | Geartner | 84/297 R |
| 2,191,776 | 2/1940 | Schreiber | 84/314 N |
| 2,214,957 | 9/1940 | Furgiuele | 84/314 N |
| 2,771,808 | 11/1956 | Jenkins | 84/304 |

FOREIGN PATENT DOCUMENTS

| | | | |
|---|---|---|---|
| 394266 | 9/1908 | France | 84/297 NR |
| 985453 | 3/1965 | United Kingdom | 84/297 R |

*Primary Examiner*—Lawrence R. Franklin
*Attorney, Agent, or Firm*—J. Michael Rosso

[57] ABSTRACT

A rod secured across the width of the guitar peghead by a plurality of spaced apart fasteners, the rod having a roller disposed thereon for each guitar string, with each roller receiving a string between the roller and the peghead, and means for securing the rollers to the rod, such that when strings are pressed down above the string nut and released they will easily slide back to their original position, thereby allowing the playing of special effects above the fretboard.

6 Claims, 3 Drawing Figures

STRING NUT

BACKGROUND OF THE INVENTION

This invention relates to guitars, and, more particularly to a string nut attachment for the guitar peghead.

The effective playing length of guitar strings on conventional guitars is determined by the guitar nut, located at the juncture of the peghead and neck, and the bridge, located at the lower end of the guitar body. That is, the strings vibrate between their points of contact at the nut and bridge. It is also possible to press down on one or more of the guitar strings above the nut to thereby stretch the strings over the nut. This results in a modification of vibration, and a unique musical sound. Such special effects cannot be readily produced on most guitars presently available, since they have notched nuts, the notching being required to insure adequate spacing between strings. In attempts to produce the special effects, the strings tend to catch in the slots, or will fail to return to their original unstretched position.

More recently, guitars have been developed with unnotched nuts, referred to as "zero nuts", at the juncture of neck and peghead, with a slotted nut disposed on the peghead. The primary function of the zero nut is to insure that each string is a set distance above the fretboard, which distance can vary considerably if notched nuts are used. However, such construction is relatively inflexible and does not permit the easy production of special effects above the fretboard, as described above. At present there are not available any peghead attachments for allowing special effects above the fretboard while at the same time insuring proper lateral spacing and height of strings above the fretboard.

SUMMARY OF THE INVENTION

In accordance with this invention there is provided a string nut attachment for guitar pegheads, the string nut comprising a plurality of rollers secured across the upper face of the peghead adjacent to the neck and in alignment with the guitar strings, the rollers being spaced slightly above the peghead with the strings running under the rollers. The cylindrical axes of the rollers are substantially parallel to the guitar frets. Special effects are produced with such attachment by pressing down on a plucked string immediately above the string nut and then releasing such pressure, after which the string will easily slide back to its original position.

The rollers of the string nut attachment are preferably disposed on a rod extending across the peghead, with the rod having a plurality of fasteners alternating with the rollers for securing them to the peghead. The fasteners can be rectangular plates having bores for receiving the rod, with each plate being secured to the peghead by means of screws running through the plate above and below the bore thereof. Further, the string nut can be provided with washers of varying thickness disposed between the rollers and the rectangular plates, for increasing or decreasing the lateral spacing between the strings. Finally, the ends of the rod can be threaded, and the assembly secured together by means of acorn nuts screwed onto the rod ends.

It is a primary object of this invention to provide a string nut attachment allowing the guitar to produce special effects above the fretboard by stretching of the strings immediately above the string nut, and wherein the strings will readily slide back to their original position.

It is another object of this invention to provide a string nut attachment for achieving greater flexibility in the playing of the guitar.

It is the further object of this invention to provide a string nut which offers the combined advantages of achieving improved lateral spacing of guitar strings while at the same time maintaining a set distance of guitar strings above the fretboard.

It is a further object of this invention to provide a string nut which allows for the increasing or decreasing of lateral spacing of guitar strings.

DESCRIPTION OF THE PREFERRED EMBODIMENTS

Figure 1:
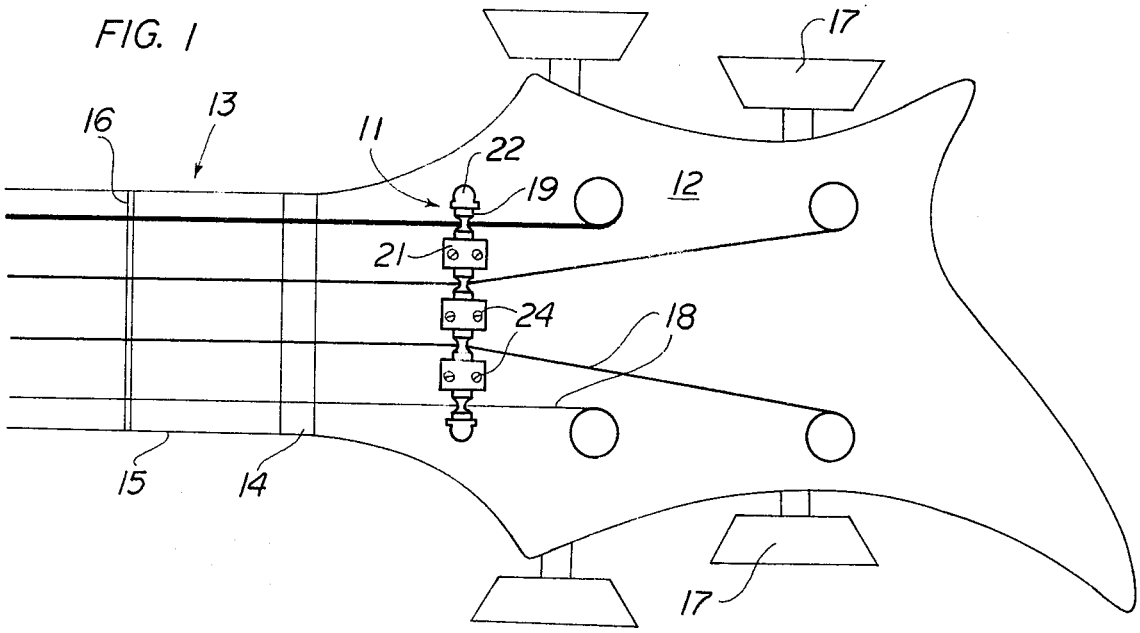
FIG. 1 is a partial front view of a guitar peghead and neck showing the attachment of the string nut of this invention to the peghead.

Referring to FIG. 1 of the drawings, string nut 11 is secured to the peghead 12 of guitar 13 adjacent zero nut 14 located at the juncture of peghead 12 and neck 15. String nut 11 is disposed across peghead 12 and parallely to the frets 16 immediately below the lower tuning pegs 17, such that guitar strings 18 can be pressed down above zero nut 14. In playing above the fretboard, the guitarist first plays one of the strings 18 and then presses down on that same string between string nut 11 and the turning peg of that string.

String nut 11 is made up of rollers 19, fasteners 21, acorn nuts 22, and a rod (not shown) running through the rollers and fasteners. String nut 11 is secured to peghead 12 with rollers 19 disposed above each of the strings 18. Screws 24 secure fasteners 21 to peghead 12.

Figure 2:
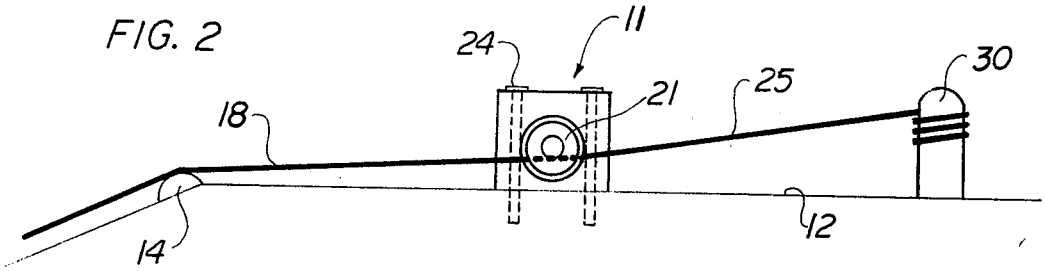
FIG. 2 is a side elevation view of the guitar shown in FIG. 1.

As shown in FIG. 2, string nut 11, with acorn nut 22 removed therefrom to better show the construction, is attached to peghead 12 at a sufficient distance above zero nut 14 such that guitar string 18 will have a portion 25 extending between string nut 11 and turning peg 30. It is at portion 25 of string 18 that the guitarist presses down to produce the special above the fretboard effect, with such downward pressure causing string 18 to stretch over zero nut 14. When downward pressure is released, the string 18 will slide back over zero nut 14 to its original position.

The combination of string nut 11 attached to peghead 12 as shown together with zero nut 14 achieves superior flexibility in playing of the guitar, due to the complete elimination of the need for notched nuts. That is, strings 18 can slide under rollers 21 and over zero nut 14 when downward pressure is exerted by the guitarist, but will otherwise remain in their fixed positions both laterally and above the fretboard. As a result, the guitarist is assured of correct intonation as well as optimum playability.

Figure 3:
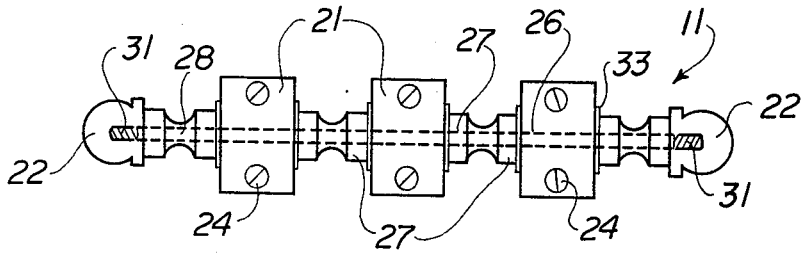
FIG. 3 is a top view of the string nut of this invention.
Figure 4:
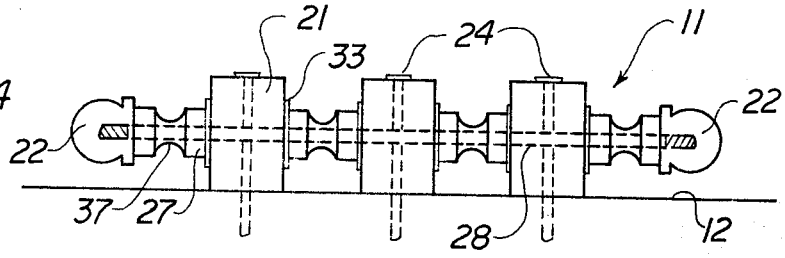
FIG. 4 is a rear view of the string nut shown in FIG. 3.

Referring to FIGS. 3, 4, string nut 11 is provided for a bass guitar having four strings. Fasteners 21 are rectangular plates having horizontal bores as indicated by dotted lines 26, the bores 26 being aligned with bores 27 of rollers 19 for reception of drill rod 28. Drill rod 28 extends through rollers 19 and fasteners 21 and has threaded ends 31. Acorn nuts 22 screw onto threaded ends 31 of drill rod 28 to thereby secure together all the components of string nut 11. Screws 24 extend above and below the bores of each rectangular plate 21 for securing string nut 11 into its proper position on peghead 12.

Washers 33 are disposed between fasteners 21 and rollers 19. If greater spacing is required between strings, thicker washers can be added to the assembly, whereas if lesser spacing is required the washers can be removed or thinner washers utilized. Accordingly, string nut 11 allows for more accurate lateral spacing of each of the guitar strings.

Rollers 19 can be rotatable or non-rotatable. It is only required that the strings ride under the rollers and be maintained within the grooves 37 thereof during playing of the guitar. The use of grooved rollers 19 instead of notched nuts, as in conventional guitars, is primarily responsible for the improved flexibility using the string nut 21 of this invention. Together with the use of a zero nut 14, string nut 11 achieves not only superior flexibility but a unique above the fretboard playability.

It is claimed:

1. A string nut for guitars comprising a plurality of rollers secured across the upper face of the peghead adjacent the neck and in alignment with the guitar strings, the rollers being spaced slightly above the peghead with the strings running under the rollers, the rollers further having their cylindrical axes substantially parallel to the guitar frets, such that when the strings are pressed down immediately above the string nut and released they will easily slide back to their original position.

2. The string nut of claim 1 wherein the rollers are disposed on a rod extending across the peghead, the rod having a plurality of fasteners alternating with the rollers for securing the rollers to the peghead.

3. The string nut of claim 2 wherein the fasteners comprise rectangular plates having bores for receiving the rod, with each plate being secured to the peghead by means of screws running through the plate above and below the bore thereof.

4. The string nut of claim 3 additionally comprising washers of varying sizes disposed between the rollers and the rectangular plates, for increasing or decreasing the spacing between the rollers.

5. The string nut of claim 4 wherein the ends of the rod are threaded, and additionally comprising acorn nuts screwed onto the threaded ends of the rod for securing together the rollers, washers, fasteners and rod.

6. In combination with a guitar having an unnotched nut above the first fret, a string nut comprising a plurality of rollers secured across the upper face of the peghead adjacent the neck and in alignment with the guitar strings, the rollers being spaced slightly above the peghead with the strings running under the rollers, the rollers further having their cylindrical axes substantially parallel to the guitar frets, such that when the strings are pressed down above the string nut and released they will easily slide back to their original position.

* * * * *